US009469969B2

(12) United States Patent
Kanari et al.

(10) Patent No.: US 9,469,969 B2
(45) Date of Patent: Oct. 18, 2016

(54) DEVICE AND METHOD FOR CALCULATING BASIC INFORMATION FOR AREA LIMITING EXCAVATION CONTROL, AND CONSTRUCTION MACHINERY

(71) Applicant: Hitachi Construction Machinery Co., Ltd., Bunkyo-ku, Tokyo (JP)

(72) Inventors: Yasuhiko Kanari, Kasumigaura (JP); Akinori Ishii, Ushiku (JP); Shuuichi Meguriya, Ishioka (JP); Eiji Egawa, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 14/769,121

(22) PCT Filed: Sep. 10, 2014

(86) PCT No.: PCT/JP2014/074002

§ 371 (c)(1),
(2) Date: Aug. 20, 2015

(87) PCT Pub. No.: WO2015/037642

PCT Pub. Date: Mar. 19, 2015

(65) Prior Publication Data

US 2016/0002882 A1 Jan. 7, 2016

(30) Foreign Application Priority Data

Sep. 12, 2013 (JP) ..... 2013-189384

(51) Int. Cl.
*E02F 9/20* (2006.01)
*E02F 3/43* (2006.01)
*E02F 9/26* (2006.01)

(52) U.S. Cl.
CPC ..... *E02F 9/2037* (2013.01); *E02F 3/435* (2013.01); *E02F 9/2033* (2013.01); *E02F 9/262* (2013.01); *E02F 9/265* (2013.01)

(58) Field of Classification Search
CPC ..... E02F 3/435; E02F 9/2033; E02F 9/2037; E02F 9/265; E02F 9/262
See application file for complete search history.

(56) References Cited

U.S. PATENT DOCUMENTS 5,701,691 A * 12/1997 Watanabe ..... E02F 9/2033 172/4
5,960,378 A 9/1999 Watanabe et al.
2005/0027420 A1 2/2005 Fujishima et al.

FOREIGN PATENT DOCUMENTS

JP 9-53253 A 2/1997
JP 2001-98585 A 4/2001
JP 2004-107926 A 4/2004

OTHER PUBLICATIONS

International Search Report (PCT/ISA/210) dated Dec. 16, 2014 with English translation (three pages).

(Continued)

*Primary Examiner* — Yuen Wong
(74) *Attorney, Agent, or Firm* — Crowell & Moring LLP

(57) ABSTRACT

A basic information calculator device calculates basic information for area limiting excavation control to control a construction machinery work device so that the construction machinery does not perform excavation beyond a target excavation surface. The basic information calculator includes: a storage device having stored therein three-dimensional information of the target excavation surface; a two-dimensional information extractor for obtaining the intersecting line between a reference surface that is the target excavation surface and the operational plane of the work device based on the three-dimensional information and the current positional information of the construction machinery to extract a reference line that is the intersecting line as the two-dimensional information of the reference surface in the operational plane; and a characteristic point transmitter for transmitting the Z-coordinates of characteristic points on the reference line to an area limiting excavation controller as the basic information.

9 Claims, 13 Drawing Sheets

(56) References Cited

OTHER PUBLICATIONS

Japanese-language Written Opinion (PCT/ISA/237) dated Dec. 16, 2014 (three pages).

International Preliminary Report on Patentability (PCT/IB/338 & PCT/IB/373) issued in PCT Application No. PCT/JP2014/074002 dated Mar. 24, 2016, including English translation of document C2 (Japanese-language Written Opinion (PCT/ISA/237)) previously filed on Aug. 20, 2015 (seven pages).

* cited by examiner (Embodiment 1)

| | | | | |
|---|---|---|---|---|
| ID-1 | Z1 | Z2 | Z3 | Z4 |
| ID-2 | Z5 | Z6 | Z7 | Z8 |
| ID-3 | Z9 | Z10 | Z11 | Z12 |
| | | | | |

(Embodiment 2)

(Embodiment 3)

| | | | | |
|---|---|---|---|---|
| ID-1 | X1 | Z1 | X2 | Z2 |
| ID-2 | X3 | Z3 | X4 | Z4 |
| ID-3 | X5 | Z5 | X6 | Z6 |
| | | | | |

(Embodiments 4 and 5)

(Embodiment 6)

(Embodiment 7)

(Embodiment 8)

DEVICE AND METHOD FOR CALCULATING BASIC INFORMATION FOR AREA LIMITING EXCAVATION CONTROL, AND CONSTRUCTION MACHINERY

TECHNICAL FIELD

The present invention relates to a device and method for calculating basic information for area limiting excavation control and to a construction machinery.

BACKGROUND ART

Some construction machineries have area limiting excavation control functions to limit the area of excavation performed by their work devices (see Patent Document 1 below).

PRIOR ART DOCUMENTS

Patent Documents

Patent Document 1: JP-2001-98585-A

SUMMARY OF THE INVENTION

Problems to be Solved by the Invention

In the device of Patent Document 1, a work device controller outputs a command signal on the basis of a control signal output from an operating device. Thus, the work device is allowed to operate according to the operation of the operating device. An external controller can be connected to the work device controller, which allows the work device controller to perform area limiting excavation control on the basis of input information from the external controller. The external controller deals with much information including the three-dimensional topographical information of a target excavation surface, described later, and is a relatively versatile controller having the functions of creating the topography of the target excavation surface and the like. In contrast, the work device controller deals primarily with the control of the work device and need be adapted to the specifications of the work device. Thus, it is desired that the external controller and the work device controller be provided as separate devices in light of the efficient controller development for higher controller availability and or maintainability.

However, the output information from the external controller to the work device controller includes the preset three-dimensional topographical information of a target excavation surface, the detected positions of particular two points on the construction machinery, the operational setting of the work device (slope excavation or horizontal excavation), the speed setting of the work device, command signals for automatic excavation, the detected angles of the components of the work device. When the amount of information transmitted from the external controller to the work device controller is large as in the above, transmitting such information requires much time. For example, when a three-dimensional target excavation surface comprises curved surfaces having large curvature factors or when the trajectory of the work device needs to be controlled precisely, area limiting excavation control may fail to keep up with the actual operation of the work device.

The present invention has been made in view of the above, and an object of the invention is to provide a device and method for calculating basic information for area limiting excavation control and a construction machinery for the purpose of making the area limiting excavation control highly efficient.

Means for Solving the Problem

To achieve the above object, the invention provides a basic information calculator for calculating basic information for area limiting excavation control to control a work device of a construction machinery so that the construction machinery does not perform excavation beyond a target excavation surface, comprising: a storage device having stored therein three-dimensional information on the target excavation surface; a two-dimensional information extractor for obtaining an intersecting line between a reference surface that is the target excavation surface or a surface calculated from the target excavation surface and an operational plane of the work device on the basis of the three-dimensional information of the target excavation surface and current positional information of the construction machinery to extract the intersecting line or a reference line calculated from the intersecting line as two-dimensional information of the reference surface in the operational plane; and a characteristic point transmitter for transmitting information on a plurality of characteristic points on the reference line to an area limiting excavation controller as the basic information.

Effect of the Invention

In accordance with the invention, area limiting excavation control can be made highly efficient.

MODES FOR CARRYING OUT THE INVENTION

Embodiments of the present invention will now be described with reference to the accompanying drawings.

Embodiment 1

1. Construction Machinery

Figure 1:
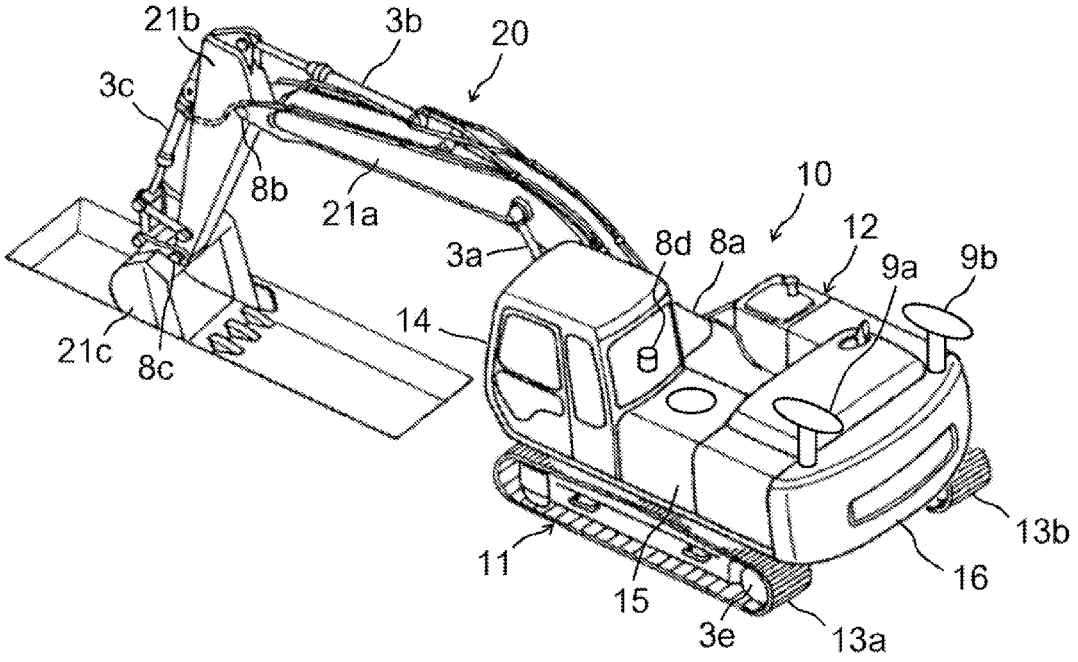
FIG. 1 is a perspective view illustrating the external structure of a hydraulic excavator as an example of a construction machinery to which the basic information calculator of Embodiment 1 of the invention is applied.

FIG. 1 is a perspective view illustrating the external structure of a hydraulic excavator as an example of a construction machinery to which the basic information calculator of Embodiment 1 of the invention is applied. In the description that follows, a front direction as viewed from the driver's seat is assumed to be the front side of the machinery (upper left side in the figure) unless otherwise specified.

While FIG. 1 illustrates a hydraulic excavator as an example of a construction machinery to which a basic information calculator according to the invention is applied, the invention can also be applied to other types of construction machineries such as bulldozers. In the present embodiment, the invention is applied to a hydraulic excavator for the purpose of illustration. The hydraulic excavator of FIG. 1 includes a vehicle body 10 and a work device 20. The vehicle body 10 includes a travel structure 11 and a main body 12.

In the present embodiment, the travel structure 11 includes left and right crawler belts 13*a* and 13*b* (caterpillar tracks for vehicle propulsion). The crawler belts 13*a* and 13*b* are driven by left and right travel motors 3*e* and 3*f* (see FIG. 2 as well) to allow the vehicle to travel. The travel motors 3*e* and 3*f* are hydraulic motors, for example.

The main body 12 is a swing structure provided swingably on the travel structure 11. A cab 14 is provided at the front section of the main body 12 (left front side in the present embodiment) for the operator to operate the machinery. An engine room 15 housing an engine, a hydraulic drive system, and so on is provided on the rear side of the cab 14 on the main body 12. A counterweight 16 is installed at the rearmost section of the main body 12 to adjust the anterior-posterior balance of the vehicle body. A swing frame, not illustrated, for connecting the main body 12 to the travel structure 11 is provided with a swing motor 3*d* (see FIG. 2). This swing motor 3*d* allows the main body 12 to swing relative to the travel structure 11. The swing motor 3*d* is a hydraulic motor, for example.

The work device 20 is attached to the front section of the main body 12 (the right side of the cab 14). The work device 20 is a multi-joint task performing device having a boom 21*a*, an arm 21*b*, and a bucket 21*c*. The boom 21*a* is connected to the frame of the main body 12 by a horizontally extending pin (not illustrated), and a boom cylinder 3*a* is used to pivot the boom 21*a* upward or downward relative to the main body 12. The arm 21*b* is connected to the distal end of the boom 21*a* by a horizontally extending pin (not illustrated), and an arm cylinder 3*b* is used to pivot the arm 21*b* relative to the boom 21*a*. The bucket 21*c* is connected to the distal end of the arm 21*b* by a horizontally extending pin (not illustrated), and a bucket cylinder 3*c* is used to pivot the bucket 21*c* relative to the arm 21*b*. The boom cylinder 3*a*, the arm cylinder 3*b*, and the bucket cylinder 3*c* can be hydraulic cylinders, for example. Having the above structure, the work device 20 pivots upward or downward in a vertical plane that extends in a front-back direction. The plane including the trajectory of the vertically pivoting work device 20 (the vertical plane extending in a front-back direction) is herein referred to as the "operational plane."

The hydraulic excavator includes detectors for detecting positional or postural information, which are provided at appropriate positions. For instance, angle detectors 8*a*, 8*b*, and 8*c* are provided at the fulcrums of the boom 21*a*, the arm 21*b*, and the bucket 21*c*, respectively. The angle detectors 8*a* to 8*c* are used as posture sensors for detecting information regarding the position and posture of the work device 20; they detect the pivot angles of the boom 21*a*, the arm 21*b*, and the bucket 21*c*. The main body 12 includes a tilt detector 8*d*, positioning devices 9*a* and 9*b*, a transceiver 9*c* (see FIG. 2), a basic information calculator 30 (see FIG. 2), and an area limiting excavation controller 40 (see FIG. 2). The tilt detector 8 is used to detect a slope that lies in a front-back direction of the main body 12. The positioning devices 9*a* and 9*b* can be an RTK-GNSS (real time kinetic global navigation satellite system) and are used to acquire the positional information of the main body 12. The transceiver 9*c* receives corrective information from GNSS reference stations (not illustrated). The basic information calculator 30 and the area limiting excavation controller 40 will be described later.

2. Hydraulic Drive System

Figure 2:
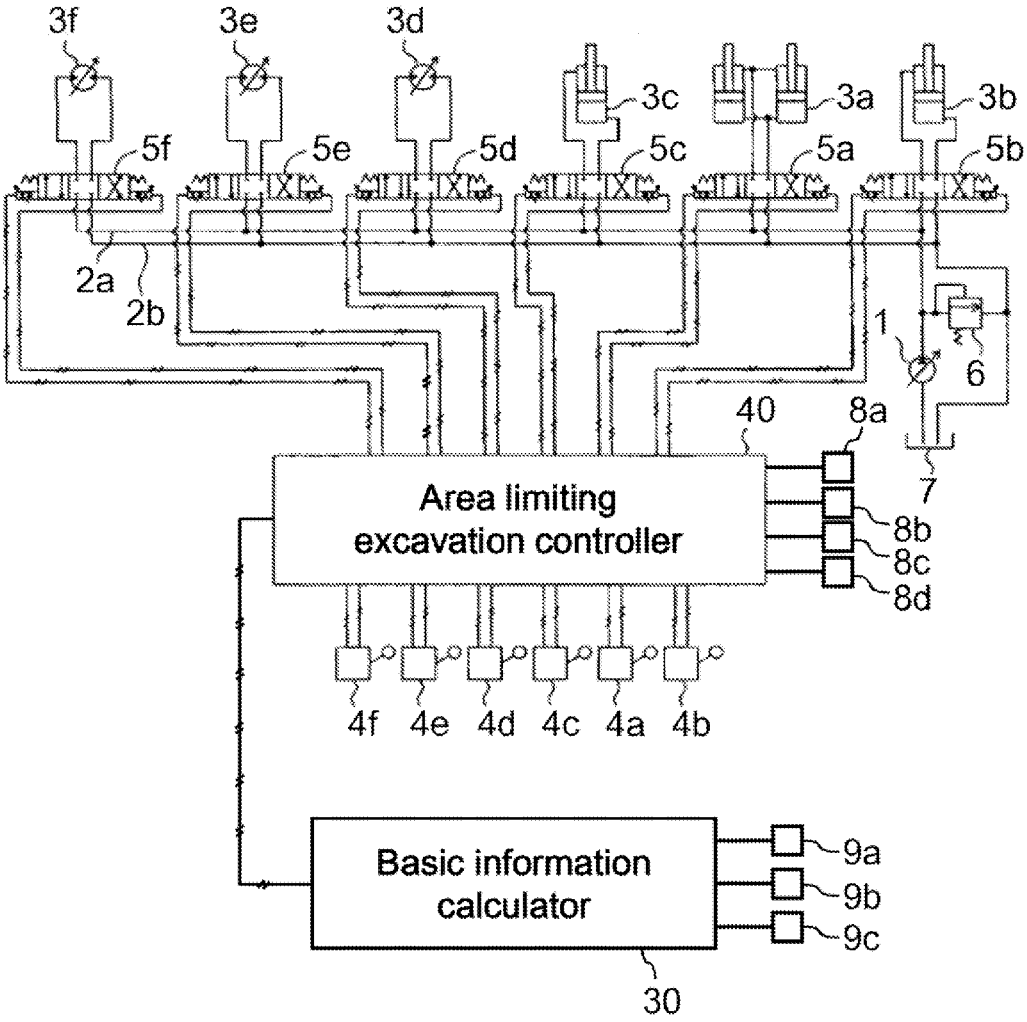
FIG. 2 illustrates the hydraulic drive system of the hydraulic excavator of FIG. 1 together with the basic information calculator and an area limiting excavation controller.

FIG. 2 illustrates the hydraulic system of the hydraulic excavator of FIG. 1 together with the basic information calculator 30 and the area limiting excavation controller 40. Those components that have already been described are assigned the same reference numerals and will not be described again.

The hydraulic drive system illustrated in FIG. 2 is used to drive particular components of the hydraulic excavators and housed in the engine room 15. Those particular components include the work device 20 (the boom 21*a*, the arm 21*b*, and the bucket 21*c*) and the vehicle body (the crawler belts 13*a* and 13*b* and the main body 12). The hydraulic drive system includes hydraulic actuators 3*a* to 3*f*, a hydraulic pump 1, operating devices 4*a* to 4*f*, control valves 5*a* to 5*f*, a relief valve 6, and so forth.

The hydraulic actuators 3*a* through 3*f* are, respectively, the boom cylinder 3*a*, the arm cylinder 3*b*, the bucket cylinder 3*c*, the swing motor 3*d*, and the travel motors 3*e* and 3*f*. These hydraulic actuators 3*a* to 3*f* are driven by the hydraulic fluid discharged from the hydraulic pump 1.

The hydraulic pump 1 is driven by an engine (not illustrated). The hydraulic fluid discharged from the hydraulic pump 1 flows through a discharge pipe 2*a* and is directed to the hydraulic actuators 3*a* to 3*f* via the control valves 5*a* to 5*f*. The returning fluid from the hydraulic actuators 3*a* to 3*f* is directed to a return pipe 2*b* via the control valves 5*a* to 5*f* and eventually directed back to a tank 7. The relief valve 6 controls the maximum pressure of the discharge pipe 2*a*.

The operating devices 4*a* to 4*f* are electric lever devices provided for the respective hydraulic actuators 3*a* to 3*f*. The operating devices 4*a* to 4*f* are installed in the cab 14 (see FIG. 1). Control signals (electric signals) transmitted from the operating levers 4*a* to 4*f* are input to the area limiting excavation controller 40 and converted into command signals (electric signals) for driving the control valves 5*a* to 5*f*. Each of the control valves 5*a* to 5*f* is an electro-hydraulic valve having electro-hydraulic converters (proportional solenoid valves) attached to its both ends, and the electro-hydraulic converters are used to convert the command signals from the area limiting excavation controller 40 into pilot pressures. The control valves 5*a* to 5*f* are subjected to switching control by the command signals output from the area limiting excavation controller 40 on the basis of the operation of the operating devices 4*a* to 4*f* and control the flow rate and direction of the hydraulic fluid supplied to the hydraulic actuators 3*a* to 3*f*.

The area limiting excavation controller 40 includes an excavation area limiting function in addition to basic vehicle control functions. The basic vehicle control functions are those functions to output command signals to the control valves 5*a* to 5*f* on the basis of the operation of the operating device 4*a* to 4*f*. The excavation area limiting function is used to limit the operational area of the work device 20. This is achieved by controlling the hydraulic actuators 3*a* to 3*c* of the work device 20 on the basis of signals from the angle detectors 8*a* to 8*c* and the tilt detector 8*d* as well as the control signals from the operating devices 4*a* to 4*f* so that the hydraulic excavator will not perform excavation beyond a target excavation surface. The basic information calculator 30 is connected to the area limiting excavation controller 40. The basic information calculator 30 outputs basic information regarding area limiting excavation control to the area limiting excavation controller 40.

3. Basic Information Calculator

Figure 3:
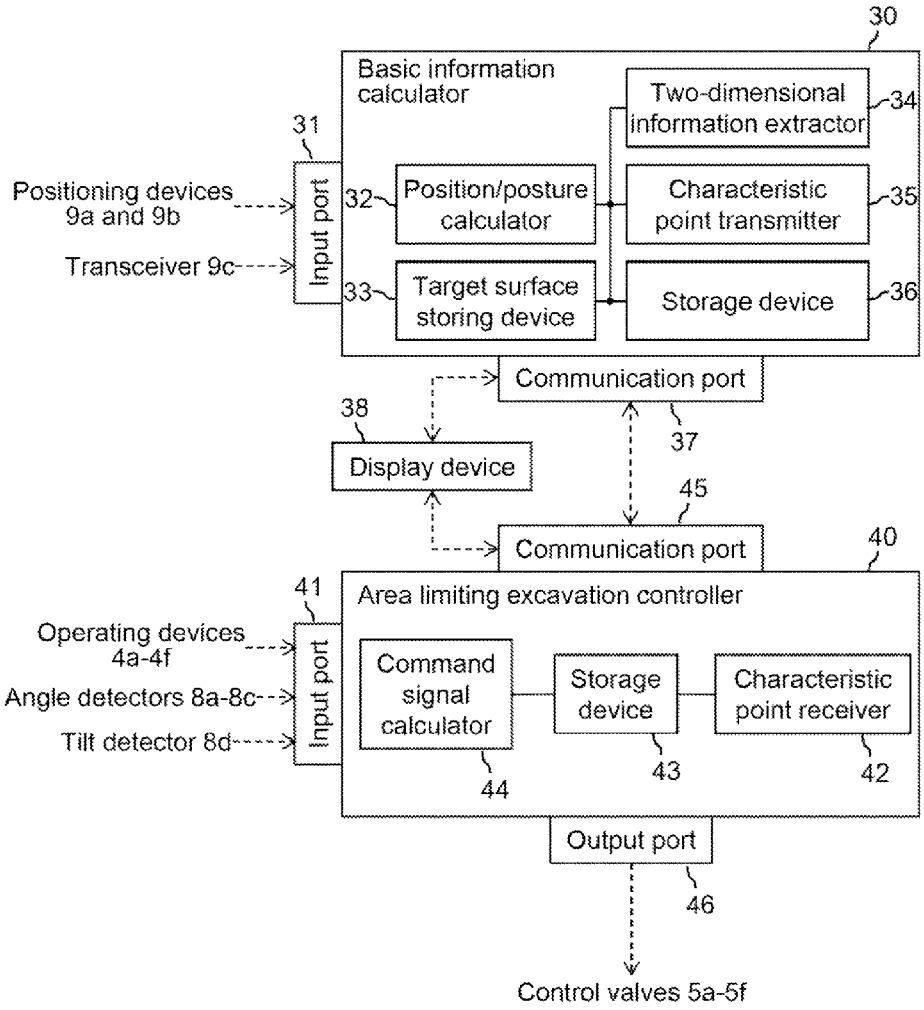
FIG. 3 is a block diagram illustrating the area limiting excavation controller and the basic information calculator of the hydraulic excavator of FIG. 1.

FIG. 3 is a block diagram illustrating the area limiting excavation controller 40, a display device 38, and the basic information calculator 30. Those components that have already been described are assigned the same reference numerals and will not be described again.

The basic information calculator 30 is a controller that calculates basic information regarding area limiting excavation control on the basis of signals input from the positioning devices 9*a* and 9*b* and the transceiver 9*c* and outputs the obtained results to the area limiting excavation controller 40. The basic information calculator 30 includes an input port 31, a position/posture calculator 32, a target surface storing device 33, a two-dimensional information extractor 34, a characteristic point transmitter 35, a storage device 36, and a communication port 37.

The input port 31 receives the current positional information obtained by the positioning devices 9*a* and 9*b* and the corrective information (corrective values for positional information) received by the transceiver 9*c*. The communication port 37 is used to send information to and receive information from the area limiting excavation controller 40 and the display device 38.

The position/posture calculator 32 calculates the current position and direction of the main body 12 on the basis of the positional information regarding two points of the main body 12 (e.g., the positions of the positioning devices 9*a* and 9*b*).

The target surface storing device 33 stores the three-dimensional positional information of a target excavation surface. The target excavation surface refers to a surface shape to be formed by the hydraulic excavator. The three-dimensional positional information of a target excavation surface refers to information obtained by adding positional data to topographical data, the latter data of which is obtained by representing the target excavation surface by polygons. Such three-dimensional positional information is prepared in advance and stored on the target surface storing device 33.

The two-dimensional information extractor 34 is used to extract the two-dimensional information of a reference surface in the operational plane of the work device 20 on the basis of the three-dimensional positional information of the target excavation surface read from the target surface storing device 33, as well as the current positional information of the hydraulic excavator output from the positioning devices 9*a* and 9*b* and the transceiver 9*c*. The reference surface can be the target excavation surface itself or a surface calculated from the target excavation surface. Examples of the latter surface include a surface obtained by shifting the target excavation surface by a certain distance and a surface obtained by tilting the target excavation surface by a certain angle, and further include a surface obtained by both shifting and tilting the target excavation surface. The two-dimensional positional information of the reference surface refers to the intersecting line between the operational plane of the work device 20 in a particular area located in front of the hydraulic excavator and the reference surface or to a line calculated from the intersecting line. Examples of the latter calculated line include a line obtained by shifting the intersecting line by a particular distance and a line obtained by tilting the intersecting line by a particular angle, and further include a line obtained by both shifting and tilting the intersecting line. The intersecting line or a line calculated from the intersecting line is hereinafter referred to as the reference line.

The characteristic point transmitter 35 transmits, as basic information for area limiting excavation control, the information of multiple characteristic points (described later) to the area limiting excavation controller 40 via the communication port 37. The characteristic points are on the reference line extracted by the two-dimensional information extractor 34. The characteristic points extracted by the characteristic point transmitter 35 will later be described in detail.

The storage device 36 includes storage areas for storing the dimensional data of the hydraulic excavator, constant values used for various calculations, programs, and storage areas for storing values calculated by the position/posture calculator 32 and the two-dimensional information extractor 34, and so forth.

4. Display Device

The display device 38 is connected to the basic information calculator 30 and the area limiting excavation controller 40. The display device 38 is used to display information on the basis of display signals from the basic information calculator 30 and the area limiting excavation controller 40 and includes an operating unit that allows the operator to make settings for or issue commands to the basic information calculator 30 or the area limiting excavation controller 40. The display device 38 is a touchscreen that acts also as the operating unit, but it can instead be a device having mechanical buttons or levers that are used by the operator.

5. Area Limiting Excavation Controller

The area limiting excavation controller 40 includes an input port 41, a characteristic point receiver 42, a storage device 43, a command signal calculator 44, a communication port 45, and an output port 46.

The input port 42 receives control signals from the operating devices 4*a* to 4*f* and detection signals from the angle detectors 8*a* to 8*c* and the tilt detector 8*d*. The characteristic point receiver 42 receives via the communication port 45 the basic information output from the basic information calculator 30. The storage device 43 stores programs and constants related to the operational control of the work device 20. According to a program read from the storage device 43, the command signal calculator 44 calculates command signals for the control valves 5*a* to 5*f*, on the basis of the control signals from the operating devices 4*a* to 4*f* and the basic information output from the angle detectors 8*a* to 8*c*, the tilt detector 8*d*, and the basic information calculator 30. The command signal calculator 44 then outputs the command signals to the control valves 5*a* to 5*f* through the output port 46. As a result, the work device 20 is allowed to follow operational commands from the operator and operate in an area that does not traverse the target excavation surface. For area limiting excavation control, any known technique is available.

6. Characteristic Points

Figures 4, 5:
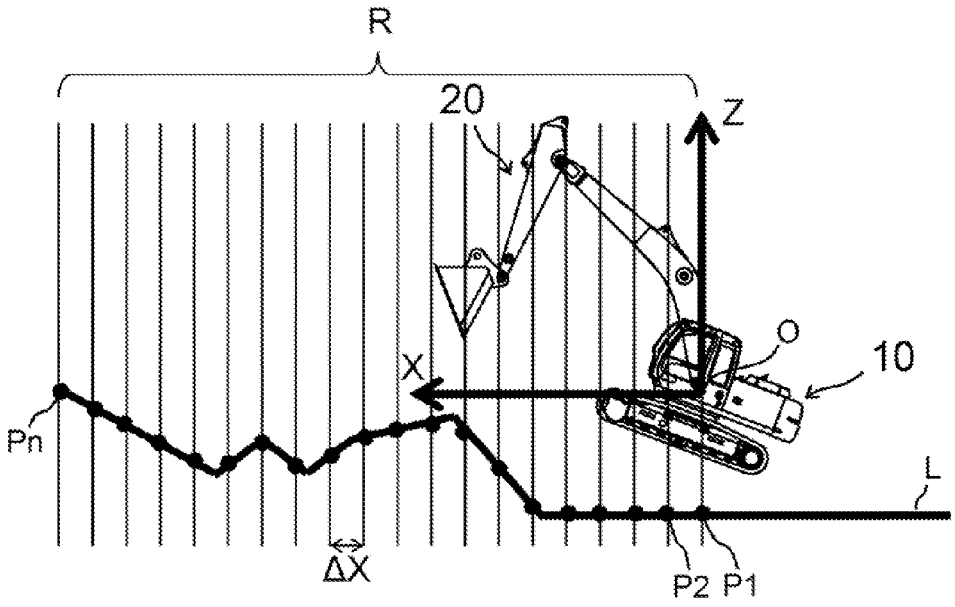
FIG. 4 illustrates the characteristic points extracted by the characteristic point transmitter of Embodiment 1.
FIG. 5 illustrates an example of characteristic point information transmitted from the basic information calculator to the area limiting excavation controller in Embodiment 1.

FIG. 4 illustrates the characteristic points extracted by the characteristic point transmitter 35 of the present embodiment. Those components that have already been described are assigned the same reference numerals and will not be described again.

As illustrated in FIG. 4, an axis extending from a reference point O of the hydraulic excavator to the front side along the operational plane of the work device 20 is assumed to be the X-axis while an axis extending from the reference point O to the upper side along the operational plane is assumed to be the Z-axis. Regardless of the posture of the hydraulic excavator, the X-axis always extends horizontally from the reference point O toward the front side along the operational plane. Likewise, the Z-axis always extends from the reference point O in a direction perpendicular to the X-axis (on the operational plane). The reference point O is the origin of the X-Z coordinate system. The reference point O can be an arbitrarily set point of the hydraulic excavator or a point calculated from it. The latter point can be a point that has particular positional relation to the arbitrary point. In the present embodiment, the reference point O is the fulcrum of the proximal section of the boom 21*a*, but it can instead be a point that has particular positional relation to the fulcrum of the proximal section of the boom 21*a*. Thus, the reference point O can also be a point except those that lie on the hydraulic excavator.

The segment line L of FIG. 4 is the above-described reference line (two-dimensional information) extracted by the two-dimensional information extractor 34. The segment line L is hereinafter referred to as the reference line L. The reference line L is the outline obtained by cutting the target excavation surface with the operational plane of the work device 20 or a line that has particular relation to the outline.

The characteristic points P1, P2, . . . , Pn extracted by the characteristic point transmitter 35 are multiple points on the reference line L that are placed at constant X-coordinate intervals. The X-coordinate of the characteristic point P1 is the X-coordinate of the reference point O (i.e., 0). The X-coordinate intervals ΔX between the characteristic points P1, P2, . . . , Pn can be about 20 cm in length although they are not limited to that length. The characteristic point information transmitted from the characteristic point transmitter 35 to the area limiting excavation controller 40 includes only the Z-coordinates of the characteristic points P1, P2, . . . , Pn.

FIG. 5 illustrates an example of the characteristic point information transmitted from the basic information calculator 30 to the area limiting excavation controller 40 in the present embodiment.

When a CAN (controller area network) is used for communication from the basic information calculator 30 to the area limiting excavation controller 40, 8-byte information is transmitted as one message. Because one piece of positional information requires 2 bytes, one message includes 4 pieces of positional information. Specifically, the message ID-1 of FIG. 5 includes the Z-coordinates Z1 to Z4 of the characteristic points P1 to P4, and the message ID-2 includes the Z-coordinates Z5 to Z8 of the characteristic points P5 to P8. Because the X-coordinates of the characteristic points P1, P2, . . . , Pn are set in advance and thus known, the X-Z coordinates of the characteristic points P1, P2, . . . , Pn are identified after the area limiting excavation controller 40 receives the Z-coordinates of the characteristic points P1, P2, . . . , Pn.

Assume in FIG. 4 that the X-coordinate operational area of the work device 20 is R, that the operational area R is equally divided by a particular number n in an X-coordinate direction, and that the divided X-coordinate distances are the intervals ΔX. In this case, the intervals ΔX change depending on the operational area R. However, the number of characteristic points is fixed to n, and the amount of data transmitted stays constant.

7. Procedure for Calculating Basic Information

Figure 6:
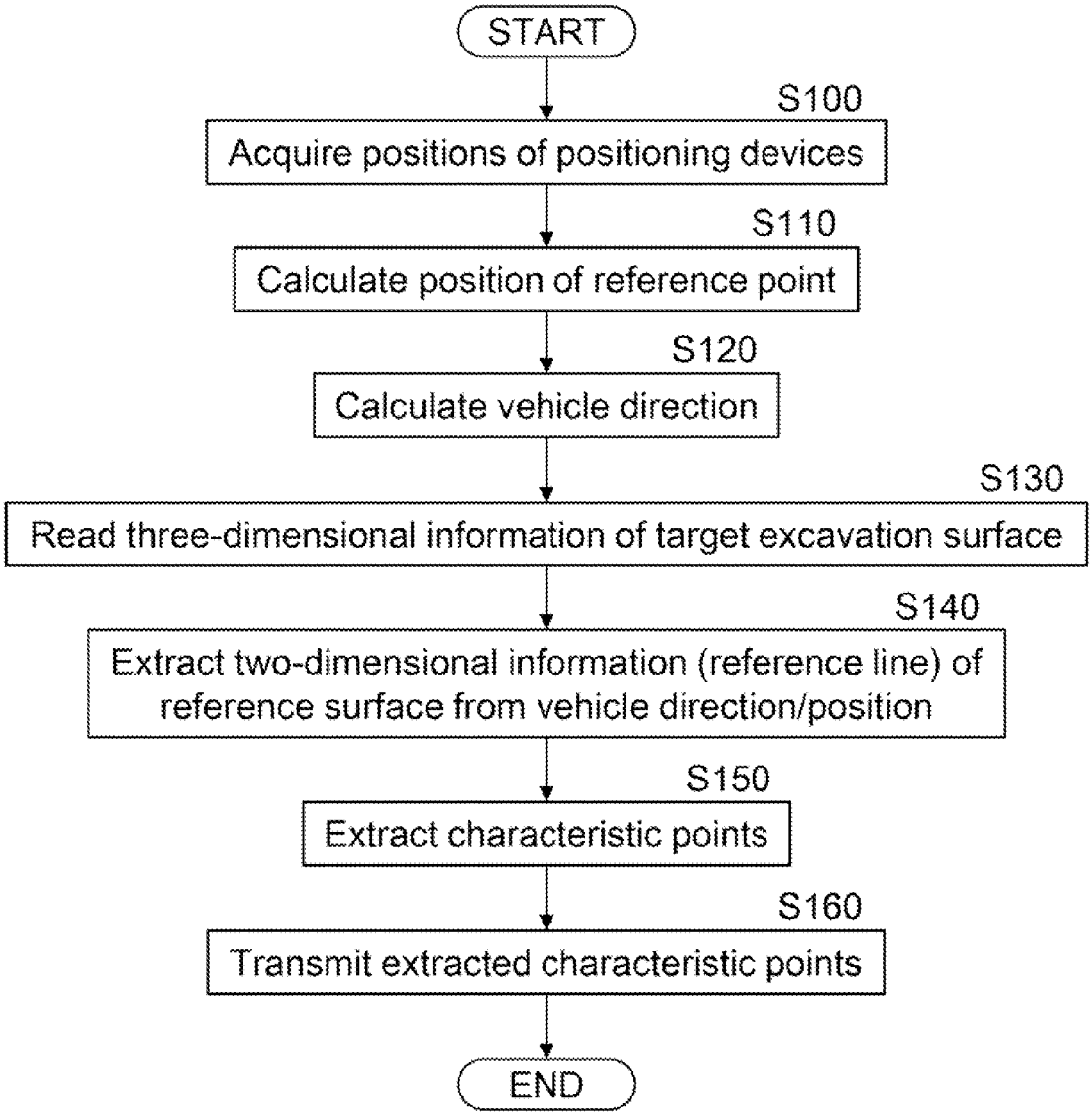
FIG. 6 is a flowchart illustrating a procedure according to Embodiment 1 performed by the basic information calculator to calculate and transmit basic information.

FIG. 6 is a flowchart illustrating a procedure performed by the basic information calculator 30 to calculate and transmit basic information.

Start

When the operator gets in the cab 14 and powers up the vehicle, the basic information calculator 30 is turned on. After particular initial processing, the procedure of FIG. 6 starts. The basic information calculator 30 repeats the procedure of FIG. 6 (from Start to End) at a constant time interval of, for example, 200 ms.

Step S100

When Step S100 starts, the position/posture calculator 32 of the basic information calculator 30 calculates the exact current three-dimensional positional information (X, Y, Z) of two points on the main body 12 (the positions of the positioning devices 9*a* and 9*b*) on the basis of the positional information from the positioning devices 9*a* and 9*b* and the corrective information from the transceiver 9*c*. The Y-axis is a coordinate axis that is perpendicular to the X- and Z-axes at the reference point O (i.e., perpendicular to the operational plane of the work device 20). The current positional information of the positioning devices 9*a* and 9*b* calculated by the position/posture calculator 32 is stored on the storage device 36.

Step S110

In Step S110, the basic information calculator 30 reads from the storage device 36 the three-dimensional positional information of the positioning devices 9*a* and 9*b* and the installation positions of the positioning device 9*a* and 9*b* on the main body 12 (known information), and the position/posture calculator 32 calculates the three-dimensional information of the current position of the reference point O (the position of the fulcrum at the proximal end of the boom 21*a*). The positional relation between the reference point O and the positioning devices 9*a* and 9*b* is known. The current positional information of the reference point calculated by the position/posture calculator 32 is stored on the storage device 36.

Step S120

In Step S120, the basic information calculator 30 reads from the storage device 36 the three-dimensional positional information of the positioning devices 9*a* and 9*b* calculated in Step S100 and the installation positions of the positioning devices 9*a* and 9*b*, thereby instructing the position/posture calculator 32 to calculate the posture of the main body 12. The postural information of the main body 12 includes the facing direction and tilts of the main body 12. The facing direction of the main body 12 is, for example, a front direction of the cab. The tilts of the main body 12 include the front, rear, right, and left tilts of the main body 12. The front and rear tilts of the main body 12 are calculated by the position/posture calculator 32 on the basis of detection signals output from the tilt detector 8*d* to the basic information calculator 30 via the area limiting excavation controller 40. The right and left tilts of the main body 12 are also calculated by the position/posture calculator 32 on the basis of the three-dimensional positional information and installation positions of the positioning device 9*a* and 9*b*. The postural information of the main body 12 calculated by the position/posture calculator 32 is stored on the storage device 36.

Step S130

In Step S130, the basic information calculator 30 reads the three-dimensional positional information of the target excavation surface from the target surface storing device 33.

Step S140

In Step S140, the basic information calculator 30 reads the calculation results of Steps S110 and S120 from the storage device 36 and instructs the two-dimensional information extractor 34 to extract the reference line (two-dimensional information of the reference surface) on the basis of the position of the reference point O, the postural information of the main body 12, and the three-dimensional positional information of the target excavation surface. The information on the reference line calculated by the two-dimensional information extractor 34 is stored on the storage device 36.

Step S150

In Step S150, the basic information calculator 30 reads the reference line from the storage device 36 and instructs the characteristic point transmitter 35 to extract characteristic points. The characteristic point transmitter 35 processes the extracted characteristic point information into information transmittable to the area limiting excavation controller 40 and stores the latter information on the storage device 36. The information processing performed here is to calculate the Z-coordinates (see FIG. 5) of the characteristic points P1, P2, . . . , Pn that have been described with reference to FIG. 4.

Step S160

In Step S160, the basic information calculator 30 instructs the characteristic point transmitter 35 to transmit the information of the characteristic points P1, P2, . . . , Pn (Z-coordinates) to the area limiting excavation controller 40 via the communication port 37.

End

As stated above, while the basic information calculator 30 is being turned on, it repeats the procedure of FIG. 6 (Step S160 is followed by Step S100). If the power is turned off after the completion of Step S160, the basic information calculator 30 performs a particular terminating operation and then stops.

8. Advantageous Effects

In the present embodiment, the basic information for area limiting excavation control transmitted from the basic information calculator 30 to the area limiting excavation controller 40 includes only the Z-coordinates of the characteristic points P1, P2, . . . , Pn. Since the basic information is thus simple and has a small data size, it is possible to make area limiting excavation control highly efficient with little time spent on communication to the area limiting excavation controller 40 (transfer of the basic information) even when the basic information calculator 30 and the area limiting excavation controller 40 are separate devices. Also, since it is possible to considerably shorten the time required to transfer the basic information, the transfer of the basic information can sufficiently precede the operation of the work device 20, thereby improving the accuracy of area limiting excavation control. Further, since the area limiting excavation controller 40, having basic functions for area limiting excavation control, and the basic information calculator 30, calculating the basic information necessary for the control, can be separate controllers, the development of construction machineries having excavation area limiting functions can be made flexible, and development efficiency can also be improved.

Embodiment 2

Figure 7:
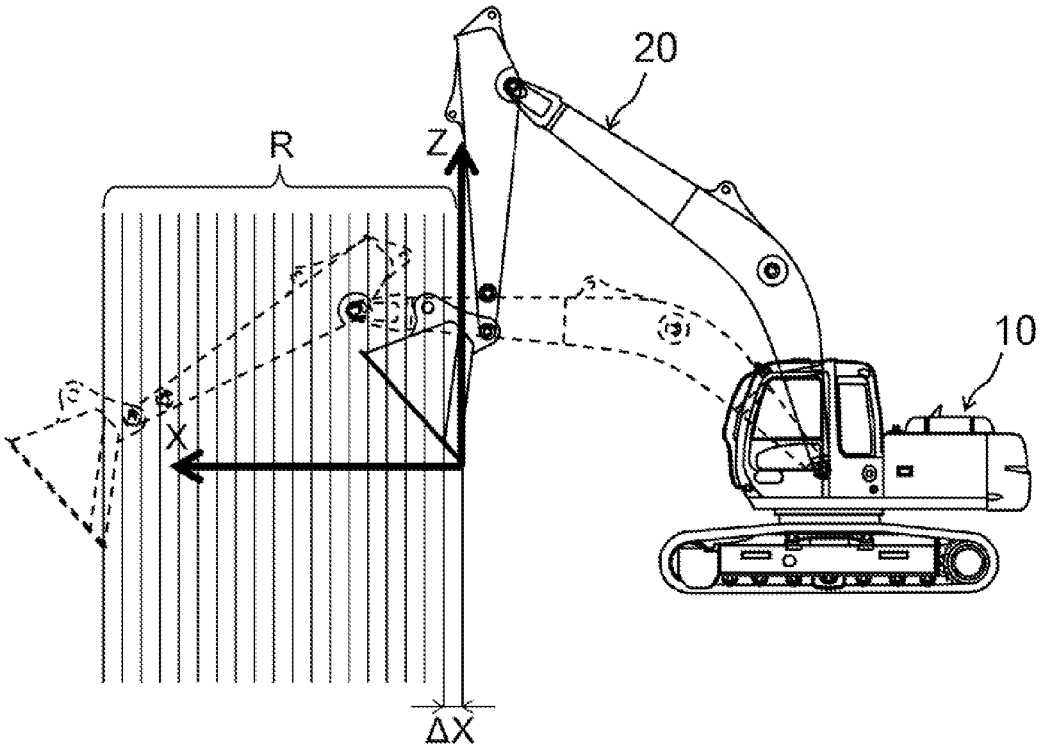
FIG. 7 illustrates Embodiment 2 of the invention.

FIG. 7 illustrates Embodiment 2 of the invention. Those components that have already been described are assigned the same reference numerals and will not be described again.

Embodiment 2 is an example in which the operator is allowed to manually set the operational area R of the work device 20, that is, the area from which the characteristic points P1, P2, . . . , Pn are obtained. In Embodiment 1, no particular description has been made as to the setting of the operational area R (see FIG. 4). In the case of Embodiment 1, the X-coordinate of the starting point (characteristic point P1) of the operational area R is 0 (the X-coordinate of the reference point O), and the X-coordinate of the ending point Pn is ($\Delta X \times (n-1)$). If the work device 20 is extended as far as possible in a front direction, then, the distal end of the bucket 21*c* becomes the ending point Pn. In that case, the intervals $\Delta X$ between the characteristic points P1, P2, . . . , Pn are the largest. On the other hand, it is rare to perform excavation using all the motion range of the work device 20. In fact, excavation is usually performed within a partial area of the motion range of the work device 20. In this case, the motion range used for excavation includes only some of the characteristic points P1, P2, . . . , Pn, resulting in reduced accuracy of the reference surface in the operational area of the work device 20 used for excavation.

Thus, in Embodiment 2, a setting device for setting the operational area R is provided for the characteristic point transmitter 35. This setting device can be a separate device, but in the present embodiment the display device 38 acts also as the setting device. Once the operational area R (the foremost and rearmost X-coordinates of the operational area R) is set with the display device 38, the characteristic point transmitter 35 obtains the X-coordinates that divide the operational area R into a set number n in an X-axis direction. The X-coordinates obtained by the characteristic point transmitter 35 are stored on the storage device 36 as the X-coordinate information of the characteristic points P1, P2, . . . , Pn and also transmitted to the area limiting excavation controller 40 to be stored on the storage device 43 of the area limiting excavation controller 40. In the present embodiment, the reference line L calculated in Step S140 of the basic information calculating procedure of FIG. 6 is obtained from the set operational area R, and in Step S150, an n number of characteristic points P1, P2, . . . , Pn in the operational area R are extracted. The rest of the structure and control procedure are similar to Embodiment 1.

Embodiment 2 prevents errors in forming the shape of the target excavation surface and improves the shape forming accuracy of excavation in addition to having advantageous effects similar to those of Embodiment 1. This is because the intervals ΔX between the characteristic points P1, P2, . . . , Pn are narrowed by appropriately limiting the operational area R accounting for the actual excavation work.

Figure 8:
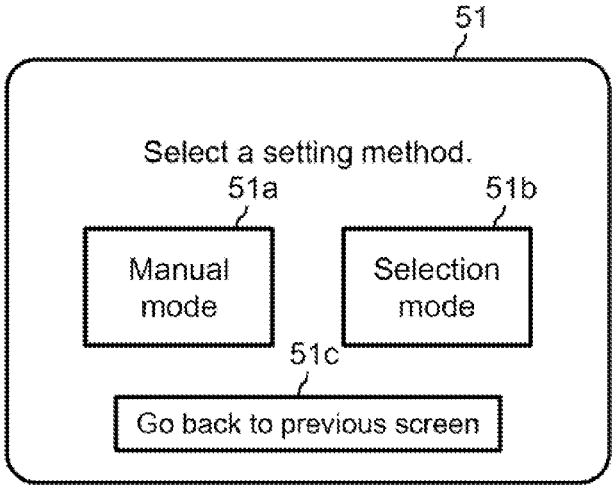
FIG. 8 illustrates an example of a menu box displayed in an operational area setting screen.

FIG. 8 illustrates an example of a menu box displayed in an operational area R setting screen of the display device 38.

The menu box 51 of FIG. 8 is displayed by the operator performing a certain operation on the screen of the display device 38. The menu box 51 includes buttons 51*a* to 51*c* along with a message prompting the selection of a setting method. The buttons 51*a* and 51*b* are used to select a setting method. Pressing the button 51*a* selects the manual mode in which the operator is allowed to specify both ends of the operational area R. Pressing the button 51*b* selects the selection mode in which the operator is allowed to select an appropriate area from among multiple preset operational areas R. When the button 51*c* is pressed, the operator can go back to the previous screen (the screen from which the operator has requested the menu box 51).

Figure 9:
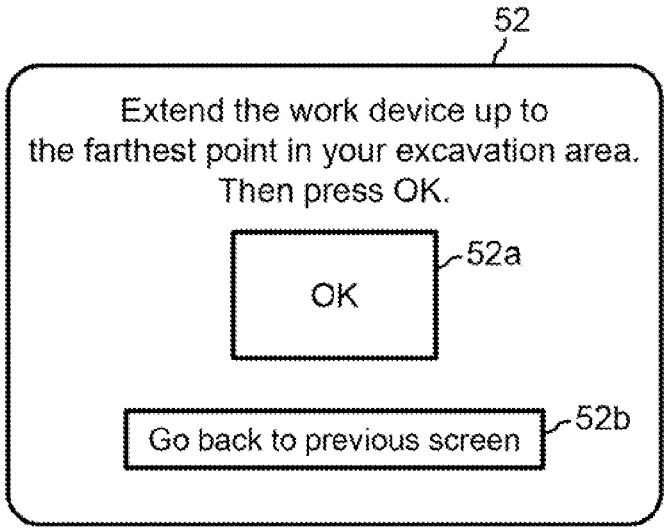
FIG. 9 illustrates an example of a manual mode box in which an operator specifies an end of an operational area.

FIG. 9 illustrates an example of a manual mode box in which the operator specifies an end of the operational area R.

The manual mode box 52 of FIG. 9 is the first box displayed when the operator presses the button 51*a* in the menu box 51. The manual mode box 52 includes a message prompting the operator's specification of the farthest point of the operational area R (the farthest point from the cab 14) and buttons 52*a* and 52*b*. The button 52*a* is used to specify the farthest point of the operational area R (the X-coordinate of the characteristic point Pn). When the operator follows the message to extend the work device 20 up to the farthest possible point of the operational area R (as illustrated by the dotted line of FIG. 7) and then presses the button 52*a*, the X-coordinate of the characteristic point Pn is set. When the button 52*b* is pressed, the operator can go back to the menu box 51.

Figure 10:
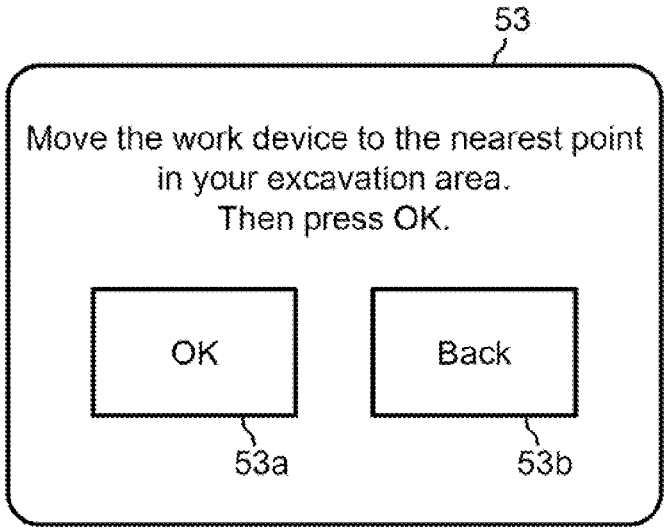
FIG. 10 illustrates an example of another manual mode box in which the operator specifies the other end of the operational area.

FIG. 10 illustrates an example of another manual mode box in which the operator specifies the other end of the operational area R.

The manual mode box 53 of FIG. 10 is the second box displayed when the operator presses the button 52*a* in the manual mode box 52. The manual mode box 53 includes a message prompting the operator's specification of the nearest point of the operational area R (the nearest point to the cab 14) and buttons 53*a* and 53*b*. The button 53*a* is used to specify the nearest point of the operational area R (the X-coordinate of the characteristic point P1). When the operator follows the message to retract the work device 20 to the nearest possible point of the operational area R (as illustrated by the solid line of FIG. 7) and then presses the button 53*a*, the X-coordinate of the characteristic point P1 is set. The setting process ends after the X-coordinate of the characteristic point P1 is specified. The operator can thereafter go back to the screen from which he or she has requested the menu box 51. When the button 53*b* is pressed, the operator can go back to the manual mode box 52.

Figure 11:
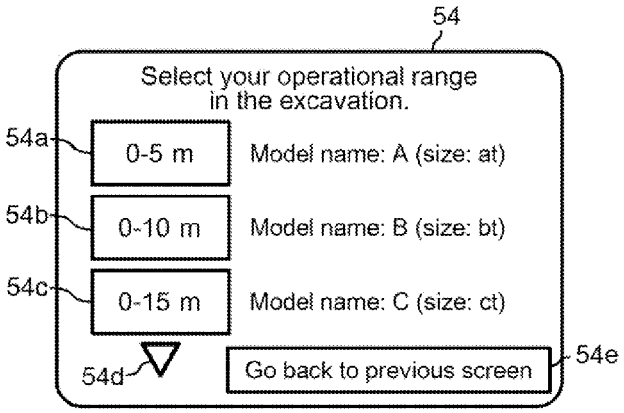
FIG. 11 illustrates an example of a selection mode box in which the operator specifies the operational area.

FIG. 11 illustrates an example of a selection mode box in which the operator specifies the operational area R.

The selection mode box 54 of FIG. 11 is displayed when the button 51*b* in the menu box 51 is pressed. The selection mode box 54 includes a message prompting the operator's specification of the operational area R and buttons 54*a* to 54*e*. The buttons 54*a* to 54*c* are used to specify the operational area R. The operator can press the proper one of the buttons 54*a* to 54*c* on the basis of the reference information shown next to them (the model name and size of the vehicle the operator is currently boarding). Pressing any one of the buttons 54*a* to 54*c* will terminate the setting of the operational area R. The operator can then go back to the screen from which he or she has requested the menu box 51. If the proper choice cannot be made from among the buttons 54*a* to 5*c*, the operator can press the button 54*d* to scroll down the screen for other buttons. Pressing one of them will terminate the setting of the operational area R. When the button 54*e* is pressed, the operator can go back to the menu box 51.

Embodiment 3

Figure 12:
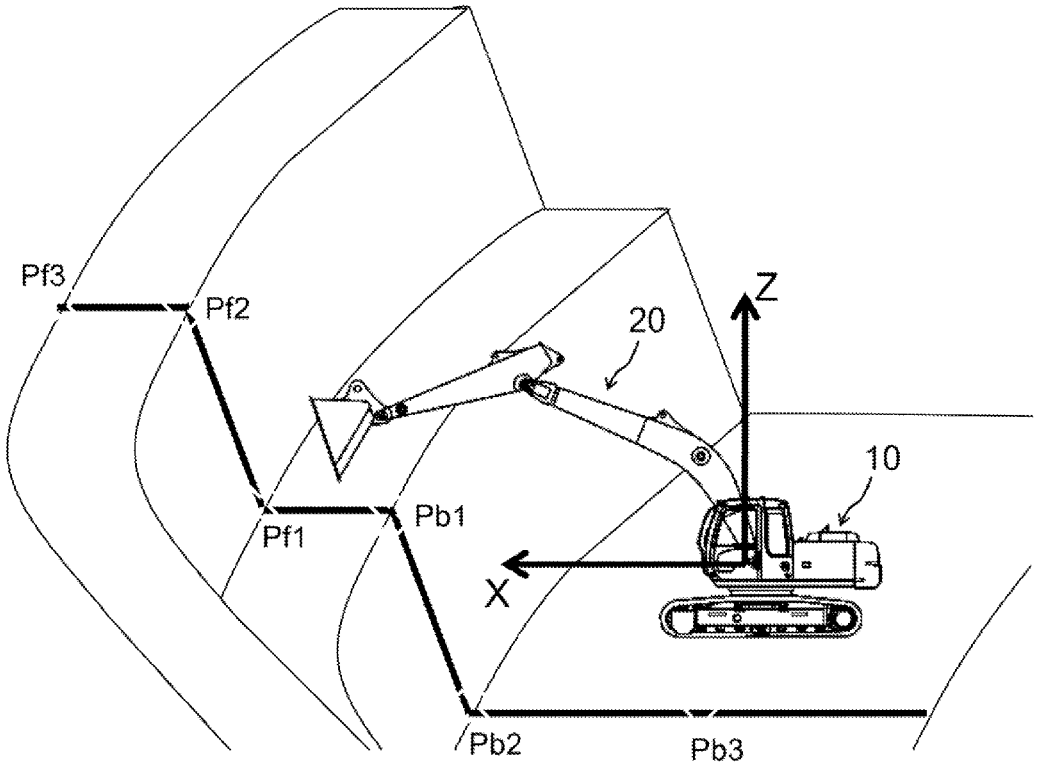
FIG. 12 illustrates Embodiment 3 of the invention.

FIG. 12 illustrates Embodiment 3 of the invention. Those components that have already been described are assigned the same reference numerals and will not be described again.

In Embodiment 3, the information regarding the reference line transmitted from the basic information calculator 30 to the area limiting excavation controller 40 takes another form. In Embodiments 1 and 2, the X-coordinates of the characteristic points P1, P2, . . . , Pn are determined in advance, and the Z-coordinates of the characteristic points P1, P2, . . . , Pn on the reference line L are transmitted from the basic information calculator 30. In contrast, the characteristic points Pb1 to Pb2 and Pf1 to Pf3 extracted in Embodiment 3 are multiple bending points on the reference line L whose X-coordinates are close to the work device 20 or multiple points calculated from those bending points. The latter points are points that have particular positional relation to the bending points and are displaced from the bending points to such an extent that the displacement does not greatly affect area limiting excavation control. The characteristic points Pb1 to Pb3 are bending points and an adjacent point taken in the direction from a particular point on the work device 20 (a width-directional central position at the distal end of the bucket 21*c*) to a −X direction. While three points are selected in the present embodiment, the number is not limited to three. Likewise, the characteristic points Pf1 to Pf3 are bending points and an adjacent point taken in the direction from the particular point on the work device 20 to a +X direction. While three points are selected in the present embodiment, the number is not limited to three. The distance from the particular point of the work device 20 to each of the bending points is determined from their X-coordinates.

To obtain the characteristic points Pb1 to Pb3 and Pf1 to Pf3, the present embodiment requires a step for extracting detection signals of the angle detectors 8*a* to 8*c* from the area limiting excavation controller 40 and calculating the current position of the particular point on the work device 20. This step can be performed by the position/posture calculator 32 or the characteristic point transmitter 35. The signals from the angle detectors 8*a* to 8*c* can also be input to the basic information calculator 30.

Figure 13:
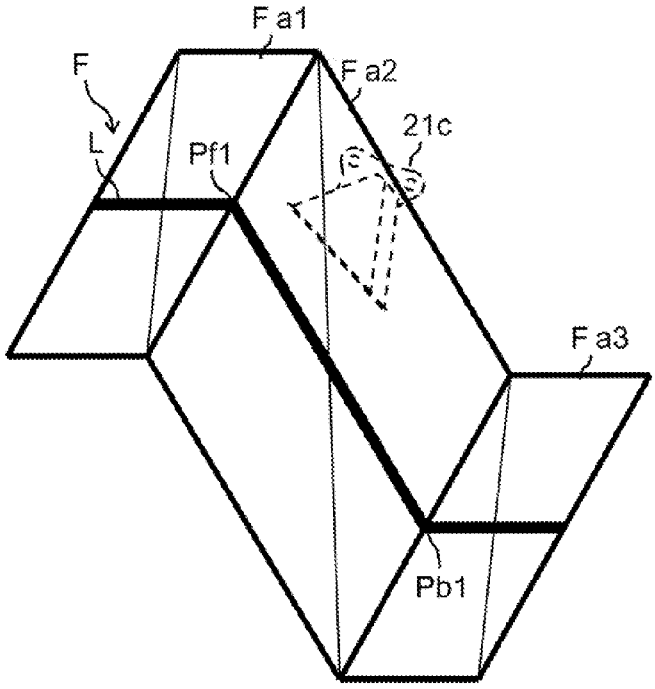
FIG. 13 illustrates characteristic points according to Embodiment 3.
Figure 14:
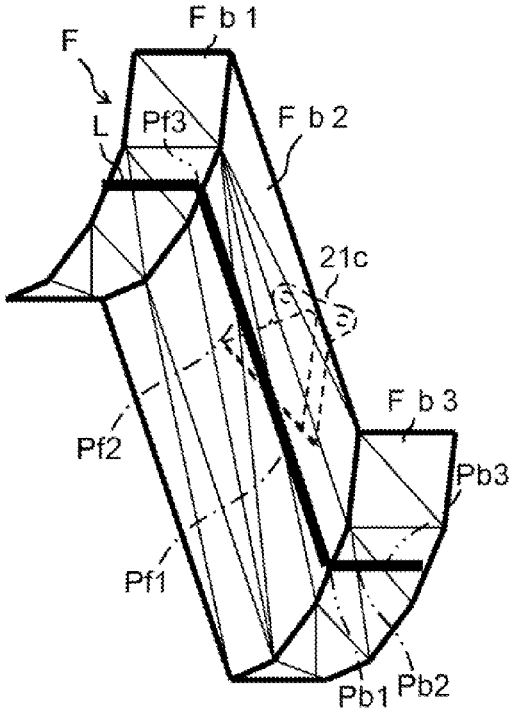
FIG. 14 illustrates characteristic points according to Embodiment 3.

FIGS. 13 and 14 illustrate the characteristic points according to Embodiment 3.

The three-dimensional information of the reference surface is represented by polygons (typically triangles). Assume now that a reference surface F has a simple shape comprising planes Fa1 to Fa3 and the number of bending points on the reference line L is small as in FIG. 13 and that the bucket 21*c* of the work device 20 is located at the position shown by the dotted line of FIG. 13. In that case, within the illustrated range, the characteristic point Pb1 is extracted in the direction from the particular point on the bucket 21*c* (the width-directional central position at its distal end) to a −X direction (rear side), and the characteristic point Pf1 is extracted in the direction from the particular point on the bucket 21*c* to a +X direction (front side).

In contrast, when the reference surface F comprises curved surfaces Fb1 to Fb3 and the number of bending points on the reference line L is larger as in FIG. 14, the characteristic points Pb1 to Pb3 are extracted in the direction from the particular point on the bucket 21*c* to a −X direction (rear side), and the characteristic points Pf1 to Pf3 are extracted in the direction from the particular point on the bucket 21*c* to a +X direction (front side) although the point extraction range stays almost the same.

As above, the intervals between extracted characteristic points differ depending on the shape of the reference surface F, and so does the number of characteristic points even in the same range. In the present embodiment, the basic information calculator 30 extracts the characteristic points Pb1 to Pb3 and Pf1 to Pf3 that have particular positional relation to the work device 20, in Step S150 of the basic information calculating procedure of FIG. 6.

Figures 15, 16:
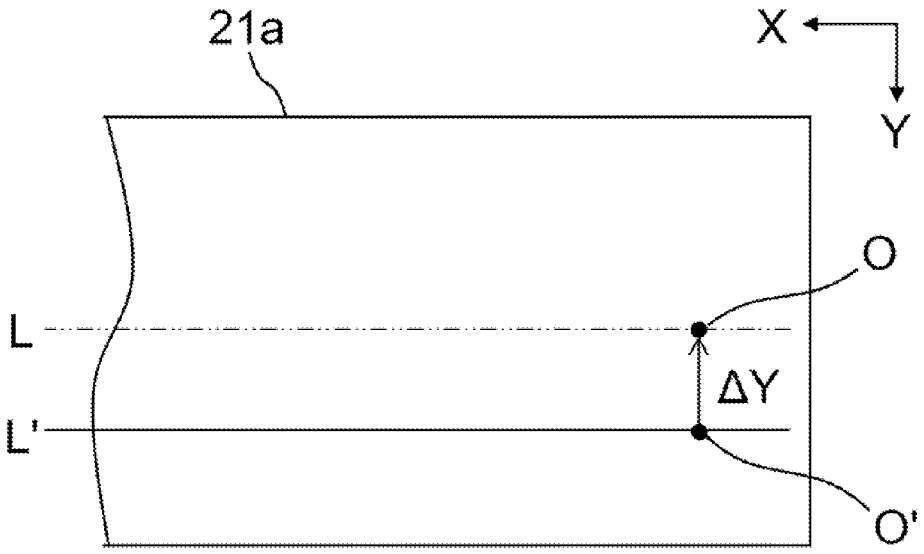
FIG. 15 illustrates an example of characteristic point information transmitted from the basic information calculator to the area limiting excavation controller in Embodiment 3.
FIG. 16 illustrates correction methods according to Embodiments 4 and 5 of the invention.

FIG. 15 illustrates an example of the characteristic point information transmitted from the basic information calculator 30 to the area limiting excavation controller 40 in the present embodiment.

As already described, when a CAN is used for communication from the basic information calculator 30 to the area limiting excavation controller 40, 8-byte information (four pieces of positional information) is transmitted as one message. The message ID-1 of FIG. 15 includes the X- and Z-coordinates of the characteristic points Pf3 and Pf2 (X1, Z1, X2, Z2). Unlike Embodiment 1, the X-coordinates of the characteristic points Pf3 and Pf2 are not known. Thus, the X- and Z-coordinates of the characteristic points Pf3 and Pf2 are transmitted. Likewise, the message ID-2 includes the X- and Z-coordinates of the characteristic points Pf1 and Pb1 (X3, Z3, X4, Z4), and the message ID-3 includes the X- and Z-coordinates of the characteristic points Pb2 and pb3 (X5, Z5, X6, Z6). According to this basic information, the area limiting excavation controller 40 identifies the characteristic points Pb1 to Pb3 and Pf1 to Pf3 to perform area limiting excavation control.

The rest of the structure and control procedure are similar to Embodiment 1.

In the present embodiment, the basic information transmitted from the basic information calculator 30 to the area limiting excavation controller 40 for area limiting excavation control includes only the X- and Z-coordinates of the characteristic points Pb1 to Pb3 and Pf1 to Pf3. Thus, the basic information is quite simple and has a small data size, similar to Embodiment 1. Accordingly, Embodiment 3 also provides advantageous effects similar to those of Embodiment 1.

In the present embodiment, as the target excavation surface becomes more complex, the X-coordinate intervals between the characteristic points Pb1 to Pb3 and Pf1 to Pf3 automatically become narrower. Since the intervals between the characteristic points are narrowed in response to the complexity of the target excavation surface, the amount of information used for area limiting excavation control increases accordingly, leading to increased shape forming accuracy of excavation.

The positional information of the positioning devices 9*a* and 9*b* detected by those devices may include errors in the values detected by the positioning devices 9*a* and 9*b* and in their installation positions. Also, due to the dimensional and manufacturing tolerances of the components of the hydraulic excavator, the calculated position of a particular point on the work device 20 may be displaced from the actual position. In such cases, the accuracy of the reference point, reference line, and reference surface will decrease, affecting area limiting excavation control. Thus, the following embodiments are presented to provide method of correcting the reference point, reference line, and reference surface. In the embodiment that follow, the fulcrum at the proximal section of the boom 21*a* (the intersecting point between a vertical surface passing the width-directional center of the boom 21*a* and the pivot axis of the boom 21*a*) is assumed to be the correct reference point. Also, the target reference surface is assumed to be the reference surface.

Embodiment 4

FIG. 16 illustrates a correction method according to Embodiment 4 of the invention. The figure is obtained by viewing the boom 21*a* from above (in a −Z direction). The present embodiment is an example of a method for correcting the reference line.

The reference point O' of FIG. 16 is a point calculated by the position/posture calculator 32 from the positions of the positioning devices 9*a* and 9*b* when no correction is made. In this example, due to errors in the values detected by the positioning devices 9*a* and 9*b* and in their installation positions and also to the dimensional and manufacturing tolerances of the components of the hydraulic excavator, the reference point O' is displaced from the correct reference point O by ΔY in a Y-coordinate direction. In this case, the operational plane of the work device 20 used by the two-dimensional information extractor 34 for calculating a reference line L' is displaced from the actual operational plane by ΔY. Thus, the reference line L' extracted is also displaced from the correct reference line L by ΔY. The present embodiment provides an exemplary method for obtaining the correct reference line L in such cases.

Figure 17:
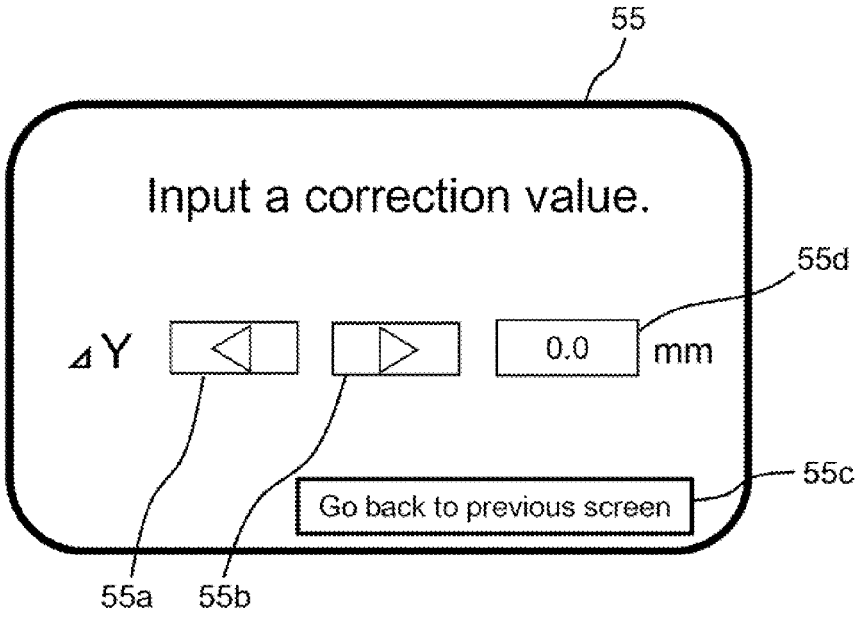
FIG. 17 illustrates an example of a displayed correction box according to Embodiments 4 and 5.

FIG. 17 illustrates an example of a displayed correction box according to the present embodiment.

The correction box 55 of FIG. 17 is used to input a correction value for the reference line L' displaced in a Y-coordinate direction (i.e., a value offsetting the offset ΔY). The correction box 55 is displayed by the operator performing a certain operation on the screen of the display device (see FIG. 3). The correction box 55 includes a message prompting the input of a correction value, buttons 55*a* to 55*c*, and an indicator 55*d* that shows the correction value input. Pressing the buttons 55*a* and 55*b* increases or decreases the correction value. For instance, pressing the button 55*a* once increases the correction value by a given amount (e.g., by 1 mm). Each time the button 55*a* is pressed, the correction value increases by that given amount. On the other hand, pressing the button 55*b* once decreases the correction value by a given amount (e.g., by 1 mm). Each time the button 55*b* is pressed, the correction value decreases by the given amount. The indicator 55*d* shows the correction value that changes by the operation of the buttons 55*a* and 55*b*, allowing the operator to monitor the current correction value. When the button 55*c* is pressed, the operator can go back to the previous screen.

The correction value set through the correction box 55 is output from the display device 38 through the communication port 37 to the basic information calculator 30 and then stored on the storage device 36 inside the basic information calculator 30. In the present embodiment, for example in Step S140 of FIG. 6, the two-dimensional information extractor 34 shifts the extracted reference line L' in a Y-coordinate direction by −ΔY on the basis of the correction value stored on the storage device 36 to obtain the reference line L. With this, the correct reference line L can be obtained, which in turn prevents the influence of the error in the reference point O on area limiting excavation control.

The advantageous effects of the present embodiment are not limited to the case where the calculated reference point O' is displaced from the reference point O. The present embodiment is also effective when the reference point O' is set such that it is displaced from the reference point O (e.g., when the positional information of the reference point O' is set in the same manner regardless of the sizes of hydraulic excavators). In this case, the precise reference points O and O' of the respective hydraulic excavators of various sizes are obtained in advance, and correction values for the reference points O' are stored in advance on the storage device 36. This allows the two-dimensional information extractor 34 to correct the reference line L' on the basis of a correction value read from the storage device 36, thereby obtaining the correct reference line L. With the use of the precise offset ΔY calculated from the reference points O and O', the accurate reference line L can be obtained.

When there is no displacement between the Y-coordinates of the reference points O and O' (ΔY=0), the above correction is not necessary (correction value=0).

Embodiment 5

While, in Embodiment 4, the reference line L' is corrected on the basis of the offset ΔY of the reference point O' to obtain the reference line L, it is also possible to correct the reference point O' into the reference point O to obtain the reference line L. The correction box of Embodiment 5 can be similar to that of Embodiment 4, and the correction value set through the correction box 55 can be stored on the storage device 36. In the present embodiment, for example in Step S110 of FIG. 6, the position/posture calculator 32 corrects the positional information of the calculated reference point O' on the basis of the correction value stored on the storage device 36 to obtain the positional information of the reference point O. As a result, in Step S140, the two-dimensional information extractor 34 can extract the reference line L from the reference surface and the operational plane passing the reference point O. With this, the correct reference line L can be obtained, which in turn prevents the influence of the error in the reference point O on area limiting excavation control. In the present embodiment, the reference line L' is not extracted.

Similar to Embodiment 4, the advantageous effects of the Embodiment 5 are not limited to the case where the calculated reference point O' is displaced from the reference point O. The present embodiment is also effective when the reference point O' is set such that it is displaced from the reference point O (e.g., when the positional information of the reference point O' is set in the same manner regardless of the sizes of hydraulic excavators). In this case, the precise reference points O and O' of the respective hydraulic excavators of various sizes are obtained in advance, and the offsets ΔY of the reference points O' relative to the reference points O are stored in advance on the storage device 36. This allows the position/posture calculator 32 to correct the reference point O' on the basis of an offset ΔY read from the storage device 36, thereby obtaining the reference point O. With the use of the precise offset ΔY calculated from the reference points O and O', the accurate reference line L can be obtained.

When there is no displacement between the Y-coordinates of the reference points O and O' (ΔY=0), the above correction is not necessary (correction value=0).

Embodiment 6

Embodiment 6 is an example in which three-dimensional correction is performed (not only in a Y-coordinate direction but also in X- and Z-directions). Specifically, by setting in advance the X-, Y-, and Z-coordinate offsets ΔX, ΔY, and ΔZ between the reference points O and O' just as ΔY is set in Embodiments 4 and 5, the reference point O' can be corrected three-dimensionally into the reference point O, or the reference line L' can be corrected three-dimensionally into the reference line L. As an example, the present embodiment is applied to the characteristic point correction of Embodiment 3.

Figure 18:
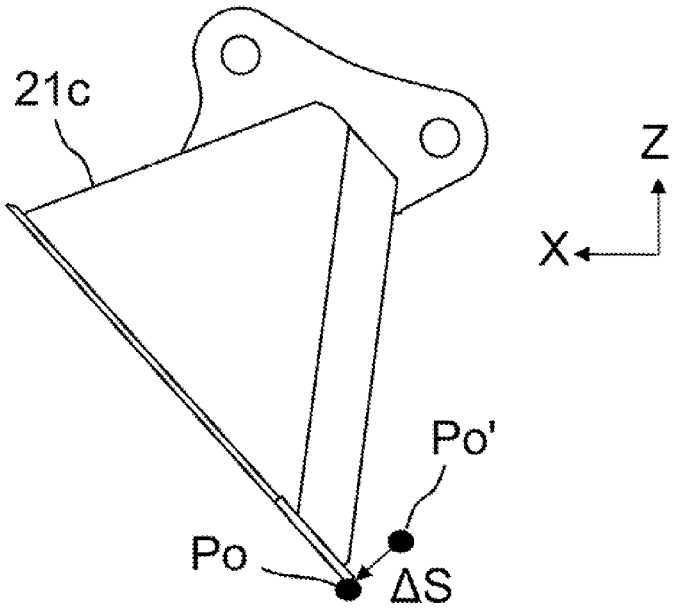
FIG. 18 illustrates a correction method according to Embodiment 6 of the invention.

FIG. 18 is a diagram used to describe a correction method according to Embodiment 6 of the invention. The figure is obtained by viewing the boom 21*a* from left (in a −Y direction). The present embodiment is also an example of a method for correcting the reference point. Those components that have already been described are assigned the same reference numerals and will not be described again.

As described with reference to Embodiment 3, the characteristic point Po' of FIG. 18 is calculated by the position/posture calculator 32 or the two-dimensional information extractor 34 on the basis of the positions of the positioning devices 9*a* and 9*b* when no correction is performed. In the present embodiment, however, the characteristic point Po' is displaced from the correct characteristic point Po at the distal end of the work device 20 by ΔX in an X-coordinate direction, by ΔY in a Y-coordinate direction, and by ΔZ in a Z-coordinate direction, due to errors in the values detected by the positioning devices 9*a* and 9*b* and in their installation positions and also to the dimensional and manufacturing tolerances of the components of the hydraulic excavator. The three-dimensional offset comprising the X, Y, and Z components of ΔX, ΔY, and AZ is hereinafter represented by ΔS. Because the characteristic point Po' is the basis for extraction of the characteristic points Pb1 to Pb3 and Pf1 to Pf3 in Embodiment 3, an error in the characteristic point Po' will results in reduced extraction accuracy of those points, affecting area limiting excavation control. Thus, in the present embodiment, the characteristic point Po' is corrected three-dimensionally into the characteristic point Po.

Figure 19:
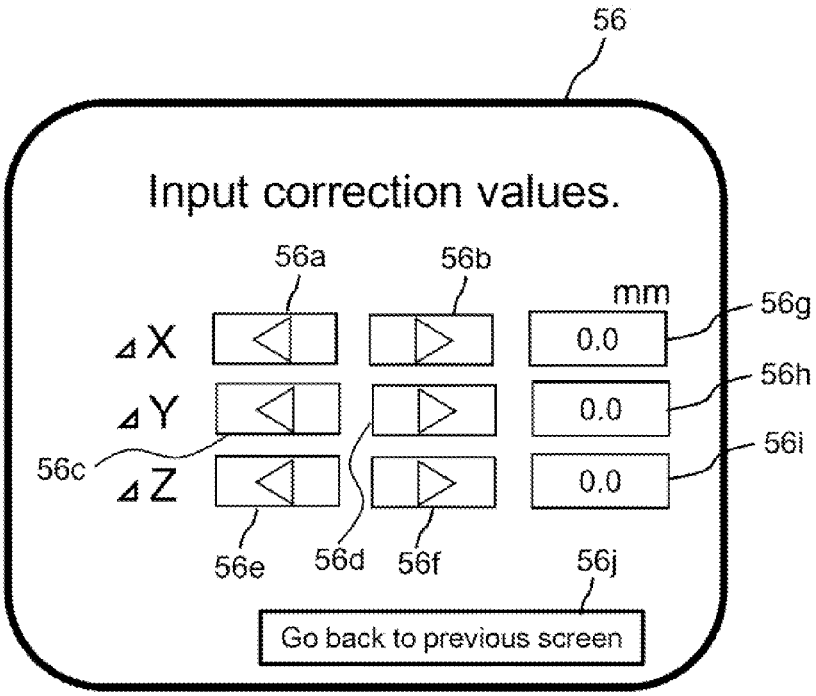
FIG. 19 illustrates an example of a displayed correction box according to Embodiment 6.

FIG. 19 is an example of a displayed correction box according to the present embodiment.

The correction box 56 of FIG. 19 is used to input the offset ΔS of the characteristic point Po' (the offsets ΔX, ΔY, and ΔZ) as a correction value and is displayed by the operator performing a particular operation on the display device 38 (see FIG. 3). The correction box 56 includes a message prompting the input of correction values, buttons 56*a* to 56*f* and 56*j*, and indicators 56*g* to 56*i* showing the correction values. Similar to the correction box 55 of FIG. 17, pressing the buttons 56*a* to 56*f* increases the correction values. For instance, pressing the button 56*a* once increases the X-coordinate correction value by a given amount (e.g., by 1 mm). Each time the button 56*a* is pressed, the correction value increases by that given amount. Also, pressing the button 56*b* once decreases the X-coordinate correction value by a given amount (e.g., by 1 mm). Each time the button 56*b* is pressed, the correction value decreases by that given amount. The indicator 56*g* shows the X-coordinate correction value that changes by the operation of the buttons 56*a* and 56*b*, allowing the operator to monitor and set the current correction value. Likewise, the indicator 56*h* shows the Y-coordinate correction value that changes by the operation of the buttons 56*c* and 56*d*, and the indicator 56*i* shows the Z-coordinate correction value that changes by the operation of the buttons 56*e* and 56*f*. When the button 56*j* is pressed, the operator can go back to the previous screen.

The correction values input through the correction box 56 are stored on the storage device 36 of the basic information calculator 30. The position/posture calculator 32 or the two-dimensional information extractor 34 corrects the calculated characteristic point Po' on the basis of the offset ΔS (ΔX, ΔY, and ΔZ) read from the storage device 36 to obtain the correct characteristic point Po. This improves the accuracy of extracting the characteristic points Pb1 to Pb3 and Pf1 to Pf3 and improves the accuracy of area limiting excavation control as well.

While, in the present embodiment, we have described an example of correcting the characteristic point Po', it is also applicable to a case where an offset ΔS (ΔX, ΔY, and ΔZ) is present between the reference points O and O' as described above. The reference point O is, as described above, the fulcrum at the proximal section of the boom 21*a* or the like. Similar to Embodiments 4 and 5, the advantageous effects of the present embodiment are not limited to the case where the calculated reference point O' is displaced from the reference point O. The present embodiment is also effective when the reference point O' is set such that it is displaced from the reference point O (e.g., when the positional information of the reference point O' is set in the same manner regardless of the sizes of hydraulic excavators).

When there is no displacement between the X-, Y-, and Z-coordinates of the characteristic points Po' and Po or the reference points O and O' (ΔX=ΔY=ΔZ=0), the above correction is not necessary (correction value=0).

Embodiment 7

Figure 20:
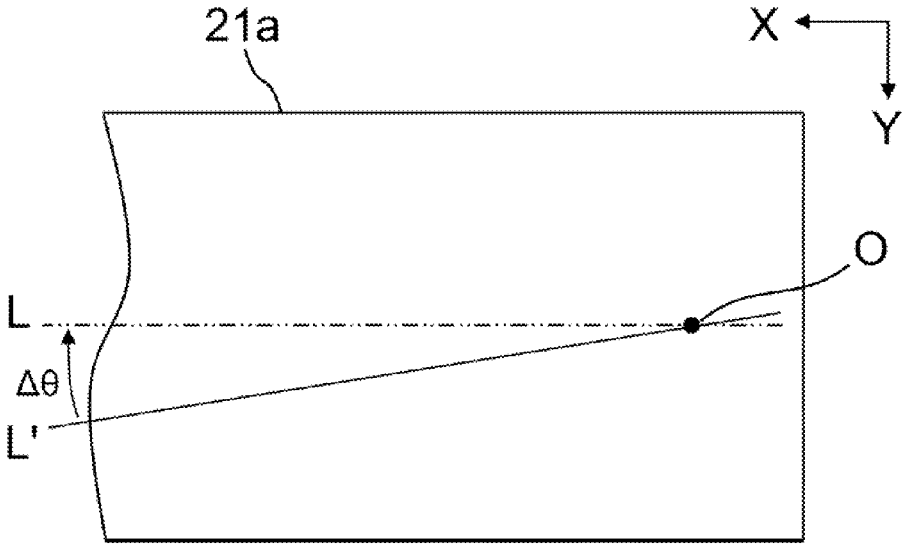
FIG. 20 illustrates a correction method according to Embodiment 7 of the invention.

FIG. 20 illustrates a correction method according to Embodiment 7 of the invention. FIG. 20 is obtained by viewing the boom 21*a* from above (in a −Z direction). The present embodiment, too, is an example of a method for correcting the reference line. Those components that have already been described are assigned the same reference numerals and will not be described again.

The reference line L' of FIG. 20 is calculated by the two-dimensional information calculator 34 on the basis of the positions of the positioning device 9*a* and 9*b* when no correction is performed. This reference line L' is tilted from the correct reference line L on the actual operational plane of the work device 20, by Δθ with respect to the reference point O, due to errors in the values detected by the positioning devices 9*a* and 9*b* and in their installation positions and also to the dimensional and manufacturing tolerances of the components of the hydraulic excavator. In this case, the offset Δθ is present between the actual operational plane of the work device 20 and the calculated operational plane. This error can affect area limiting excavation control. Thus, in the present embodiment, the tilt of the reference line L' is corrected to obtain the correct reference line L.

Figure 21:
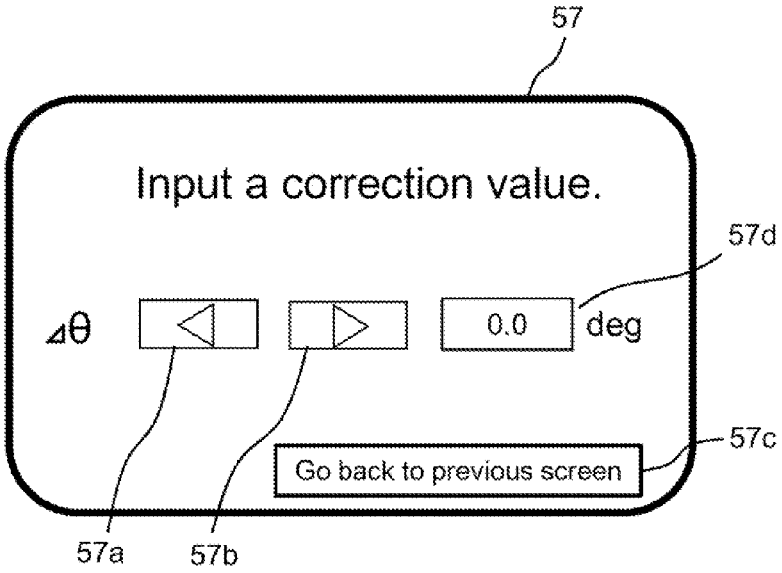
FIG. 21 illustrates an example of a displayed correction box according to Embodiment 7.

FIG. 21 is an example of a displayed correction box according to the present embodiment.

The correction box 57 of FIG. 21 is used to input a correction value for the rotational direction of the reference line (a value that offsets the offset Δθ) and is displayed by the operator performing a particular operation on the display device 38 (see FIG. 3). The correction box 57 includes a message prompting the input of a correction value, buttons 57*a* to 57*c*, and an indicator 57*d* showing the correction value. Pressing the buttons 57*a* and 57*b* increases the correction values. For instance, pressing the button 57*a* once increases the correction value by a given amount (e.g., by 1 degree). Each time the button 57*a* is pressed, the correction value increases by that given amount. Also, pressing the button 57*b* once decreases the correction value by a given amount (e.g., by 1 degree). Each time the button 57*b* is pressed, the correction value decreases by that given amount. The indicator 57*d* shows the correction value that changes by the operation of the buttons 57*a* and 57*b*, allowing the operator to monitor the current correction value. When the button 57*c* is pressed, the operator can go back to the previous screen.

The correction value set through the correction box 57 is output from the display device 38 through the communication port 37 to the basic information calculator 30 and stored on the storage device 36 inside the basic information calculator 30. In the present embodiment, for example in Step S140 of FIG. 6, the two-dimensional information calculator 34 rotates the extracted reference line L' by Δθ on the basis of the correction value stored on the storage device 36 to obtain the reference line L. With this, the correct reference line L can be obtained for the work device 20, which in turn prevents the influence of the error in the reference line L' on area limiting excavation control.

When there is no displacement between the reference lines L and L' (Δθ=0), the above correction is not necessary (correction value=0).

While, in the present embodiment, we have described an example of correcting the tilt of the extracted reference line L', it is also possible to correct the tilt of the operational plane to obtain the correct reference line L.

Embodiment 8

Figure 22:
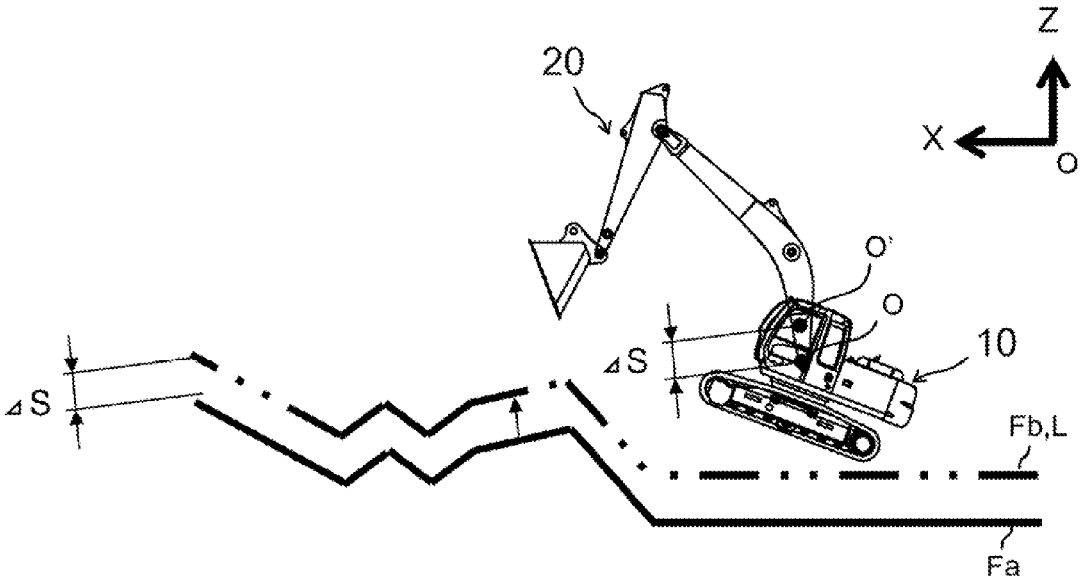
FIG. 22 illustrates a correction method according to Embodiment 8 of the invention.

FIG. 22 illustrates a correction method according to Embodiment 8 of the invention. FIG. 22 is obtained by viewing the hydraulic excavator from left (in a −Y direction). The present embodiment is an example of a method for correcting the reference surface. Those components that have already been described are assigned the same reference numerals and will not be described again.

The reference point O' of FIG. 22 is displaced three-dimensionally (in a diagonally upward direction) from the reference point O by an offset ΔS due to errors. In this case, errors resulting from the offset ΔS can occur between the actual trajectory of the work device 20 and the calculated trajectory. Because the actual fulcrum at the proximal section of the work device 20 is located at a lower position than the reference point O', the excavator will excavate deeper into the ground than the calculated excavation position. Thus, in the present embodiment, the target excavation surface Fa stored on the target surface storing device 33 of the basic information calculator 30 is shifted by the offset ΔS in the diagonally upward direction in such a way as to match the displacement of the reference point O' from the reference point, thereby calculating a reference surface Fb. Since the reference surface Fb is shifted upward, the shape of a surface to be excavated by the work device 20 will be the same as that of the target excavation surface Fa, which offsets the error in the trajectory of the work device 20 resulting from the displacement of the reference point O'.

The correction box of FIG. 19 can also be used in the present embodiment. A correction value set through the correction box is stored on the storage device 36 of the basic information calculator 30. The two-dimensional information extractor 34 can read the offset ΔS (ΔX, ΔY, and ΔZ) from the storage device 36 and shift the target excavation surface Fa by ΔS to obtain the reference surface Fb. The two-dimensional information extractor 34 then extracts the reference line L from the calculated reference surface Fb. This prevents a decrease in the accuracy of area limiting excavation control.

When there is no displacement between the X-, Y-, and Z-coordinates of the reference points O and O'(ΔX=ΔY=ΔZ=0), the above correction is not necessary (correction value=0).

Similar to Embodiments 4 and 5, the advantageous effects of the present embodiment are not limited to the case where the calculated reference point O' is displaced from the reference point O. The present embodiment is also effective when the reference point O' is set such that it is displaced from the reference point O (e.g., when the positional information of the reference point O' is set in the same manner regardless of the sizes of hydraulic excavators).

The foregoing embodiments can be implemented in a combined manner as desired.

DESCRIPTION OF THE REFERENCE NUMERALS

8*a*-8*c*: Angle detector (posture sensor)
9*a*, 9*b*: Positioning device
10: Vehicle body
20: Work device
30: Basic information calculator
33: Target surface storing device (storage device)
34: Two-dimensional information extractor
35: Characteristic point transmitter
40: Area limiting excavation controller
F: Reference surface
L: Reference line
P1, P2, . . . , Pn, Pb1-Pb3, Pf1-Pf3: Characteristic point

The invention claimed is:

1. A basic information calculator device for calculating basic information for area limiting excavation control to control a work device of a construction machinery so that the construction machinery does not perform excavation beyond a target excavation surface, comprising:

a storage device having stored therein three-dimensional information on the target excavation surface;

a two-dimensional information extractor device configured to obtain an intersecting line between a reference surface that is the target excavation surface or a surface calculated from the target excavation surface and an operational plane of the work device on a basis of the three-dimensional information of the target excavation surface and current positional information of the construction machinery, and extract a reference line that is the intersecting line or a line calculated from the intersecting line as two-dimensional information of the reference surface in the operational plane; and a characteristic point transmitter for transmitting information on a plurality of characteristic points on the reference line as the basic information, wherein the construction machinery comprises:

an area limiting excavation controller for performing the area limiting excavation control based on the basic information received from the basic information calculator device so that the construction machinery does not perform excavation beyond the target excavation surface; and a display device that is connected to the basic information calculator device and the area limiting excavation controller.

2. The basic information calculator device of claim 1, wherein when an axis that extends in a front direction along the operational plane from a reference point that is an arbitrary point on the construction machinery or a point calculated from the arbitrary point is assumed to be an X-axis and an axis that extends upward from the reference point along the operational plane is assumed to be a Z-axis, the characteristic point transmitter extracts as the characteristic points a plurality of points existing on the reference line at constant X-coordinate intervals and transmits only Z-coordinates of the characteristic points to the area limiting excavation controller.

3. The basic information calculator device of claim 2, wherein X-coordinates of the plurality of characteristic points extracted by the characteristic point transmitter are coordinates that divide an operational area into a particular number in an X-coordinate direction, and wherein the basic information calculator device further comprises a setting device for setting the operational area for the characteristic point transmitter.

4. The basic information calculator device of claim 1, wherein when an axis that extends in a front direction along the operational plane from a reference point that is an arbitrary point on the construction machinery or a point calculated from the arbitrary point is assumed to be an X-axis and an axis that extends upward from the reference point along the operational plane is assumed to be a Z-axis, the characteristic point transmitter extracts on a basis of positional information of the work device a plurality of bending points on the reference line whose X-coordinates are close to the work device or a plurality of points calculated from the plurality of bending points as the characteristic points and transmits X-Z coordinates of the plurality of characteristic points to the area limiting excavation controller.

5. A construction machinery comprising:

a vehicle body;

a work device provided on the vehicle body;

a positioning device for acquiring positional information of the vehicle body;

a posture sensor for detecting postural information of the work device;

a basic information calculator device for calculating basic information for area limiting excavation control, comprising:

a storage device having stored therein three-dimensional information on a target excavation surface;

a two-dimensional information extractor device configured to:

obtain an intersecting line between a reference surface that is the target excavation surface or a surface calculated from the target excavation surface and an operational plane of the work device on a basis of the three-dimensional information of the target excavation surface and current positional information of the construction machinery, and extract a reference line that is the intersecting line or a line calculated from the intersecting line as two-dimensional information of the reference surface in the operational plane; and a characteristic point transmitter for transmitting information on a plurality of characteristic points on the reference line as the basic information;

an area limiting excavation controller that controls the work device of the construction machinery so that the construction machinery does not perform excavation beyond the target excavation surface based on the basic information; and a display device that is connected to the basic information calculator device and the area limiting excavation controller.

6. A basic information calculating method for calculating basic information for area limiting excavation control to control a work device of a construction machinery so that the construction machinery does not perform excavation beyond a target excavation surface, comprising steps of:

obtaining, by a two-dimensional information extractor device, an intersecting line between a reference surface that is the target excavation surface or a surface calculated from the target excavation surface and an operational plane of the work device on a basis of three-dimensional information of the target excavation surface and current positional information of the construction machinery;

after the obtaining, extracting, by the two-dimensional information extractor device, a reference line that is the intersecting line or a line calculated from the intersecting line as two-dimensional information of the reference surface in the operational plane;

inputting information on a plurality of characteristic points on the reference line to an area limiting excavation controller as the basic information; and controlling, by the area limiting excavation controller, the work device of the construction machinery so that the construction machinery does not perform excavation beyond the target excavation surface based on the basic information.

7. The method of claim 6, wherein when an axis that extends in a front direction along the operational plane from a reference point that is an arbitrary point on the construction machinery or a point calculated from the arbitrary point is assumed to be an X-axis and an axis that extends upward from the reference point along the operational plane is assumed to be a Z-axis, a plurality of points existing on the reference line at constant X-coordinate intervals are extracted as the characteristic points, and only Z-coordinates of the characteristic points are input to the area limiting excavation controller.

8. The method of claim 7, wherein an X-coordinate range to be used for excavation that lies in an operational area of the work device is set and wherein the characteristic points are a plurality of X-coordinate points on the reference line that divide the operational area into a particular number in an X-coordinate direction.

9. The method of claim 6, wherein when an axis that extends in a front direction along the operational plane from a reference point that is an arbitrary point on the construction machinery or a point calculated from the arbitrary point is assumed to be an X-axis and an axis that extends upward from the reference point along the operational plane is assumed to be a Z-axis, a plurality of bending points on the reference line whose X-coordinates are close to the work device or a plurality of points calculated from the plurality of bending points are extracted as the characteristic points, and X-Z coordinates of the plurality of characteristic points are input to the area limiting excavation controller.

* * * * *